United States Patent [19]

Grünwald et al.

[11] Patent Number: 4,728,362

[45] Date of Patent: Mar. 1, 1988

[54] HIGH VOLTAGE ELECTRODES FOR THE IGNITION SYSTEM OF INTERNAL COMBUSTION ENGINES AND METHOD FOR MAKING THE SAME

[75] Inventors: Werner Grünwald, Gerlingen; Hans-Peter Koch, Stuttgart; Gundmar Leuze, Heimsheim; Hans Neu, Vaihingen, all of Fed. Rep. of Germany

[73] Assignee: Robert Bosch GmbH, Stuttgart, Fed. Rep. of Germany

[21] Appl. No.: 887,132

[22] PCT Filed: Dec. 5, 1985

[86] PCT No.: PCT/DE85/00508

§ 371 Date: Apr. 22, 1986

§ 102(e) Date: Apr. 22, 1986

[30] Foreign Application Priority Data

Dec. 24, 1984 [DE] Fed. Rep. of Germany ..... 3447342

[51] Int. Cl.[4] ..... C22C 29/00

[52] U.S. Cl. ..... 75/231; 75/230; 419/10; 419/32; 419/33; 419/36; 419/37; 419/39; 419/54; 219/146.23

[58] Field of Search ..... 419/10, 36, 37, 32, 419/33, 39, 54; 75/230, 231; 219/146.23

[56] References Cited

U.S. PATENT DOCUMENTS

| | | | |
|---|---|---|---|
| 1,972,463 | 9/1934 | Ludwigshafen | 419/10 |
| 2,116,399 | 5/1938 | Marth | 419/10 |
| 3,256,699 | 6/1966 | Henderson | 419/10 |
| 4,282,420 | 8/1987 | Banks | 219/145.22 |

*Primary Examiner*—Stephen J. Lechert, Jr.
*Attorney, Agent, or Firm*—Michael J. Striker

[57] ABSTRACT

To increase service life and suppress interferences in high voltage electrodes for the ignition distributing system of internal combustion engines, the electrodes consist of molded and sintered mixture of 50–90% by weight iron powder and 50–10% by weight calcium silicide. Preferably, the electrode has tipstretched contact area of nonalloyed iron.

9 Claims, 1 Drawing Figure

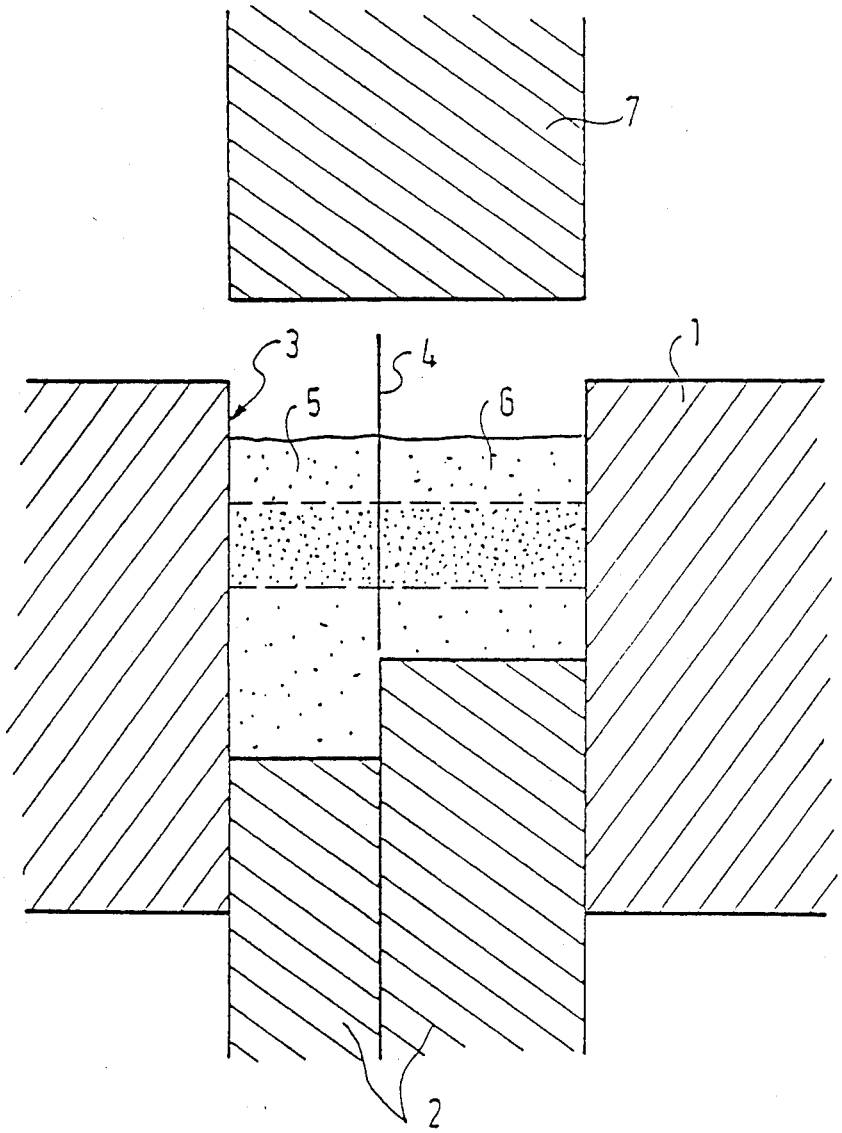
7
3
4
1
5
6
2

HIGH VOLTAGE ELECTRODES FOR THE IGNITION SYSTEM OF INTERNAL COMBUSTION ENGINES AND METHOD FOR MAKING THE SAME

STATE OF THE ART

The invention relates to high voltage electrodes in accordance with the type of the main claim. A device for the ignition voltage distribution in ignition system designed for internal combustion engines is described in the DE-OS No. 31 36 745, wherein electrodes are used which have calcium and silicon as main components. However, it is disadvantageous that this material in sintered condition does not have the hardness or toughness required for a high service life. A further disadvantage of such electrodes is that it is hard to contact them, since this material is hard to solder and hard to weld.

ADVANTAGES OF THE INVENTION

In contrast thereto the inventive high voltage electrodes which in addition to calcium and silicon contain iron have the advantage that they have a sufficient hardness for a long life span in the sintered condition and that they can be more easily soldered and welded and can be more easily contacted with a carbon brush than the aforementioned material. The method in accordance with claim 6 is advantageous in that demixing of the two components is eliminated, which otherwise can easily occur, since the CaSi has a density of about 2.5 g/cm$^3$, and iron has a density of about 7.8 g/cm$^3$.

Further embodiments and improvements of the high voltage electrodes stated in the main claim are made possible by the measures stated in the subclaims. For an optimum contacting it is particularly advantageous when the actual high voltage electrode has a tipstretched contact area which consist solely of iron.

DRAWING

One exemplified embodiment of the invention is illustrated in the drawing and is explained in more detail in the subsequent description. The FIGURE illustrates schematically a section of a mold provided with a separating wall for making a high voltage electrode with a tipstretched contact area.

DESCRIPTION OF THE EXEMPLIFIED EMBODIMENT

For making a high voltage electrode 70% by weight iron powder with a granular size of <0.2 mm, 29% by weight calcium silicide powder in the screen fraction of <0.2 mm as well as 1.0% by weight calcium wolframate $CaWO_4$ or sodium molybdate $Na_2MoO_4$ are thoroughly mixed. A nonalloyed iron powder is used as an iron powder, the calcium silicide powder substantially consists of $CaSi_2$ with small components of $Ca_2Si$ and CaSi. The adding of calcium wolframate or sodium molybdate serves for the reduction of the burning voltage, whereby the interference in the ignition distributor in which the electrode is used is improved. After adding 1% by weight of a solid organic binder substance like, for example, ethyl cellulose which had been dissolved in a diluting oil, the powder mixture is granulated by the fluid bed method until a size of the granulate from 0.2 to 0.4 mm is obtained. This preparation of the powder to be processed by means of a granulating process, although unusual when processing metal powders, is necessary in order to improve poor fluidity of the powder as well as poor hardness and edge durability of molded elements made from such powders, and, in the first place to prevent a demixing of iron and calcium silicide. One has to take into consideration that iron has a density of about 7.8 g/cm$^3$, while the calcium silicide density is only at about 2.5 g/cm$^3$, so that an untreated powder mixture has the tendency that the iron powder gradually settles downwardly. Due to the granulating process this danger of demixing id completely eliminated, moreover round granulate particles are formed and have a good fluidity after the evaporation of the thinning oil that increased temperature and can therefore be very well processed in the following operating steps.

The finished granulate to which a slight amount of a customary organic lubricant had been added, for example, zinc stearate is filled into a press mold, as schematically illustrated in the drawing. The mold consists of wall 1 and two movably disposed lower plungers or dies 2 forming together with the wall a hollow chamber 3 corresponding to the shape of the part to be made. The granulate 5 whose manufacturing had just been described is filled into the deeper part of the hollow chamber, while in the other part of the hollow chamber nonalloyed iron powder 6 is filled, and also the lubricant is added. Due to the fact that the compression relationships of the two types of powder 5 and 6 are different, different filling heights result for the two powders. The compression relationship is defined as the relationship of the height of a powder column with respect to the height of the molded body which is generated under a defined pressure. During the compression process both lower dies are brought to the same height. Thus, it is assured that in both types of powders 5 and 6 a defined molding density and a sufficient stability for the further processing is guaranteed. For example, if one would operate with nonseparated lower dies to fill in the powders 5 and 6 at the same level and would then start to mold, a sufficient stability would be obtained for the iron powder 6, however the calcium silicide powder 5 would not have the required stability. In the concrete case, the relationship of the filling levels, as is required for the further processing, has to be established experimentally. After the powders 5 and 6 are filled in, the separating wall 4 is removed from the mold 4, an upper die 7 is introduced and the molding is performed at about 4 000 bar. The generated blank represents a composition of the actual high voltage electrode consisting of the iron and the calcium silicide and the contact part which consist solely of iron. The blank is removed from the mold and is at first heated to a temperature of 400° C. under a protective gas of a $N_2/H_2$ mixture for evaporating the binder and lubricant substances and is finally sintered in a furnace, also under a protective gas, at a temperature of about 1050° C. for 0.5 hours. Thereafter, the finished high voltage electrode can be used either in combination with an interference suppressing resistor, or in direct contact with the carbon brush of a high voltage feed of an ignition distributor.

It has been shown that the electrical characteristics correspond to the hitherto used high voltage electrodes, while the stability is considerably higher and the contactability is improved to a high degree, in that the connecting conductors can be soldered or welded thereto in a simple manner.

We claim:

1. High voltage electrode for the ignition stystem of internal combustion engines, comprising 50–90% by weight iron and 50–10% by weight calcium silicide.

2. High voltage electrode in accordance with claim 2, further comprising tungsten and/or molybdenum.

3. High voltage electrode in accordance with claim 2, comprising 0.5 to 2.0% by weight tungsten and/or molybdenum.

4. High voltage electrode for the ignition distributing system of internal combustion engines, consisting of calcium, silicon and iron.

5. High voltage electrode in accordance with claim 4, comprising a tipstretched contact area consisting of a ductile metal, preferably nonalloyed iron.

6. Method of making high voltage electrodes for the ignition system of internal combustion engines, comprising the steps of mixing iron powder and calcium silicide powder, adding a binder, granulating the mixture, filling the granulate into a mold and molding the same, evaporating the binder, and sintering the granulate under a protective gas.

7. Method as defined in claim 6 further comprising the step of mixing calcium wolfromate and/or sodium molybdate to the iron powder and calcium silicide powder.

8. Method as defined in claim 6, wherein particle size of the iron and calcium silicide powder is <0.2 mm, the mixture is granulated after adding 0.5–3% by weight organic binder, 0.2–2% by weight of a pulverized organic lubricant is added to the granulate and the granulate is molded in a mold under pressure of about 4000 bar, then the resulting blank is removed from the mold and heated to a temperature between 300° and 500° C. under a protective nitrogen-hydrogen gas mixture to evaporate binder and lubricant substances, and then sintered at a temperature between 900°–1200° C.

9. Method as defined in claim 6 wherein said mold is separated by a separating wall into two chambers having different depths, and further comprising the steps of filling iron powder into a deeper chamber and said granulate into the other chamber, then removing the separating wall and simultaneously molding contents of both chambers to the same level, removing the blank, heating the blank to a temperature of 300°–500° C. under a protective nitrogen-hydrogen gas mixture, and then sintering the blank at a temperature of 900°–1200° C. to produce an electrode having a tip stretched contact area of nonalloyed iron.

* * * * *